United States Patent [19]

Kunitz et al.

[11] Patent Number: 4,833,070

[45] Date of Patent: May 23, 1989

[54] COLOR PHOTOGRAPHIC RECORDING MATERIAL CONTAINING A YELLOW DIR COUPLER

[75] Inventors: Friedrich-Wilhelm Kunitz, Leverkusen; Hans Öhlschläger, Bergisch Gladbach; Heinrich Odenwälder, Leverkusen; Dirk Hübner, Cologne, all of Fed. Rep. of Germany

[73] Assignee: Agfa-Gevaert Aktiengesellschaft, Leverkusen, Fed. Rep. of Germany

[21] Appl. No.: 90,457

[22] Filed: Aug. 28, 1987

[30] Foreign Application Priority Data

Sep. 9, 1986 [DE] Fed. Rep. of Germany ..... 3630564

[51] Int. Cl.[4] ..... G03C 7/36

[52] U.S. Cl. ..... 430/505; 430/544; 430/557

[58] Field of Search ..... 430/544, 557, 389, 505

[56] References Cited

U.S. PATENT DOCUMENTS

| | | | |
|---|---|---|---|
| 4,182,630 | 1/1980 | Quaglia | 430/557 |
| 4,273,961 | 6/1981 | Shiba et al. | 430/557 |
| 4,359,521 | 11/1982 | Fryberg et al. | 430/557 |
| 4,579,816 | 4/1986 | Ohlschlager et al. | 430/557 |
| 4,617,256 | 10/1986 | Kunitz et al. | 430/557 |

*Primary Examiner*—Paul R. Michl
*Assistant Examiner*—Mark R. Buscher
*Attorney, Agent, or Firm*—Connolly & Hutz

[57] ABSTRACT

Remarkably high interimage and Eberhard effects are obtained when yellow DIR couplers corresponding to formuls I are added to multilayered color photographic recording materials, in particular to the green-sensitive or red-sensitive layers. These couplers can improve the sharpness and color reproduction.

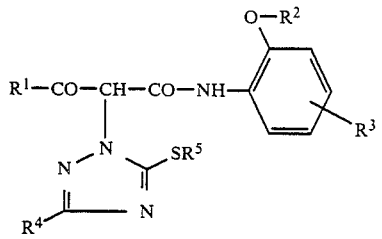

I $R^1$ denoted alkyl or aryl,
$R^2$ denotes alkyl with up to 18 carbon atoms,
$R^3$ denotes halogen, $SO_2—R^6$, $SO_2—NR^7—R^8$ or $NH—SO_2—R^6$,
$R^4$ denoted H, alkyl or aryl.
$R^5$ denotes alkyl, cycloalkyl, alkinyl, aralkyl or aryl,
$R^6$ denotes alkyl or aryl,
$R^7$ denotes H or alkyl and
$R^8$ denoted H, alkyl, aryl, $CO—R^6$ or

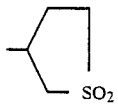

and the total number of carbon atoms in $R^4$ and $R^5$ is not greater than 11.

4 Claims, No Drawings

COLOR PHOTOGRAPHIC RECORDING MATERIAL CONTAINING A YELLOW DIR COUPLER

This invention relates to a colour photographic recording material having at least one light-sensitive silver halide emulsion layer containing a yellow coupler which releases a development inhibitor in the process of colour development.

It is known that chromogenic development may be carried out in the presence of compounds from which diffusible substances capable of inhibiting the development of silver halide are released imagewise in the process of development. Compounds of this kind are known as so-called DIR compounds (DIR=development inhibitor releasing). These DIR compounds may be of the kind which react with the oxidation product of a colour developer to release an inhibitor and at the same time form a dye (DIR couplers) or they may be compounds which release the inhibitor without forming a dye. The latter compounds are referred to as DIR compounds in the narrower sense of the word.

DIR couplers have been disclosed, for example, in U.S. Pat. Nos. 3,148,062, 3,227,554, 3,615,506 and 3,617,291.

The released development inhibitors are generally heterocyclic mercapto compounds or derivatives of benzotriazoles. DIR compounds which mainly give rise to colourless products in the coupling reaction are mentioned, for example, in U.S. Pat. No. 3,632,345, DE-A-2 359 295 and DE-A-2 540 959. DIR compounds may be used to produce numerous photographic effects which influence the quality of the image. These effects include, for example, lowering of the gradation, formation of a finer colour grain, improvement in the sharpness of the image by the so-called Eberhard effect and improvement in the colour purity and brilliance by so-called interimage effects. See, for example, the publication entitled "Development-Inhibitor-Releasing (DIR) Couplers in Color Photography" by C. R. Barr, J. R. Thirtle and P. W. Vittum, in Photographic Science and Engineering 13, 74 (1969).

The DIR compounds which couple to form colourless products have the advantage over DIR couplers which give rise to coloured products in that they are universally applicable so that one and the same compound may be used in all the light-sensitive layers of a colour photographic recording material regardless of the colour to be produced. DIR couplers, on the other hand, can only be used in some of the light-sensitive layers if the colour side densities produced by them are not acceptable in the other layers. Set against this advantage of DIR compounds is the disadvantage that they are generally less reactive than DIR couplers. On the whole, therefore, only DIR couplers have been used in the past, and if necessary two or more different couplers were used in the same photographic material so that the layers sensitized to different regions of the spectrum could be associated with different DIR couplers according to the colour produced from the latter.

DIR couplers derived from yellow couplers and containing a 3-alkylthio-1,2,4-triazolyl group as releasable inhibitor are described in DE-A-2 842 063. When the DIR couplers described in the said Specification are used in a blue-sensitive silver halide emulsion layer, the color gradation in this layer may be considerably reduced but the effect on adjacent silver halide layers, in particular on adjacent green-sensitive and/or red-sensitive silver halide emulsion layers is comparatively slight. Only weak interimage effects can therefore be obtained with the known DIR couplers. DIR couplers derived from yellow couplers and containing a releasable 3-alkylthio-5-furyl-1,2,4-triazole group are described in DE-A-3 427 235. These couplers have a satisfactory remote effect in the sense of an interimage effect when used in the blue-sensitive layer. They may also be used successfully in green-sensitive layers but are then required at higher concentrations to produce an adequate interimage effect, with the result that the yellow side density which must be compensated is too high. These compounds are virtually ineffective in red-sensitive layers.

It is an object of the present invention to provide a colour photographic recording material containing yellow DIR couplers with which comparatively high interimage effects can be produced even when they are used in magenta or cyan layers.

The present invention relates to a colour photographic recording material having at least one light-sensitive silver halide emulsion layer and a DIR coupler associated with this layer, this coupler being a yellow coupler having a releasable 1,2,4-triazolyl group attached in the coupling position, characterised in that the DIR coupler corresponds to the following formula I

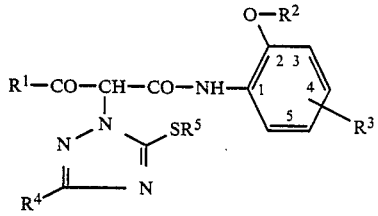

I wherein $R^1$ denotes alkyl or aryl, $R^2$ denotes alkyl with up to 18 carbon atoms, $R^3$ denotes halogen, $SO_2$—$R_6$, $SO_2$—$NR^7$—$R^8$ or NH—$SO_2$—$R^6$, $R^4$ denotes H, alkyl or aryl, $R^5$ denotes alkyl, cycloalkyl, alkinyl, aralkyl or aryl, $R^6$ denotes alkyl or aryl, $R^7$ denotes H or alkyl, and $R^8$ denotes H, alkyl, aryl, —CO—$R^6$ or

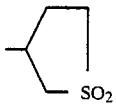

and the total number of carbon atoms in $R^4$ and $R^5$ is not greater than 11.

An alkyl group denoted by $R^1$ in formula I may be straight chained or branched; methyl and t-butyl are preferred examples. A cycloalkyl group denoted by $R^1$ is preferably cyclopentyl or cyclohexyl. An aryl group denoted by $R^1$ is preferably a substituted phenyl group, e.g. an alkoxyphenyl group.

An alkyl group denoted by $R^4$ in formula I preferably contains up to 7 carbon atoms, methyl, ethyl, propyl, isopropyl nd heptyl being examples.

The group denoted by $R^5$ in formula I preferably contains not more than 8 carbon atoms. If it is an alkyl group, it preferably has at least 6 carbon atoms. An alkinyl group denoted by $R^5$ is preferably propinyl.

According to the structure shown in formula I, the 1,2,4-triazole ring is attached to the coupling position of the yellow coupler by one of its two adjacent ring nitrogen atoms. Since, however, it has to this day not been clarified whether this represents the true structure, formula I should be taken to apply also to isomers in which the 1,2,4-triazole ring may be attached to the coupling position by any of its other ring nitrogen atoms.

Examples of suitable yellow DIR couplers according to the present invention are shown below.

| DIR-coupler (DIR-) | $R^1$ | $R^2$ | $R^3$ | $R^4$ | $R^5$ |
|---|---|---|---|---|---|
| 1 | $-C_4H_9-t$ | $-C_{16}H_{33}$ | $5\text{-}SO_2-NH-CO-C_2H_5$ | H | $-C_6H_{13}$ |
| 2 | $-CH_3$ | $-CH_3$ | $5\text{-}SO_2-NH-C_{18}H_{37}$ | H | $-C_6H_{13}$ |
| 3 | $-CH_3$ | $-C_{16}H_{33}$ | 5-Cl | H | $-C_6H_{13}$ |
| 4 | $-CH_3$ | $-C_{16}H_{33}$ | 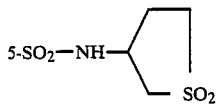 | H | $-C_6H_{13}$ |
| 5 | $-CH_3$ | $-C_{16}H_{33}$ | $5\text{-}SO_2-NH_2$ | H | $-C_6H_{13}$ |
| 6 | $-CH_3$ | $-C_{16}H_{33}$ | $5\text{-}SO_2-NCH_3-C_4H_9$ | H | $-C_6H_{13}$ |
| 7 | 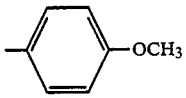 | $-C_{16}H_{33}$ | $5\text{-}SO_2-NCH_3-C_4H_9$ | H | $-C_6H_{13}$ |
| 8 | 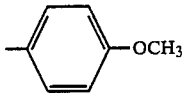 | $-C_{16}H_{33}$ | $5\text{-}SO_2-C_2H_5$ | H | $-C_6H_{13}$ |
| 9 | 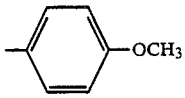 | $-C_{16}H_{33}$ | $5\text{-}SO_2-NH-CO-C_2H_5$ | H | $-C_6H_{13}$ |
| 10 | 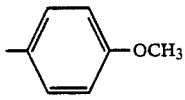 | $-CH_3$ | 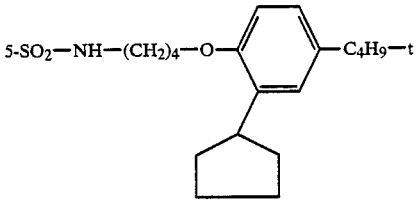 | H | $-C_6H_{13}$ |
| 11 | 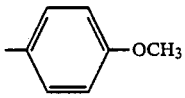 | $-C_{16}H_{33}$ | 5-Cl | H | $-C_6H_{13}$ |
| 12 | 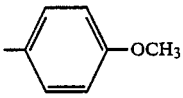 | $-C_{16}H_{33}$ | $5\text{-}SO_2-NH-CH_3$ | H | $-C_6H_{13}$ |
| 13 | 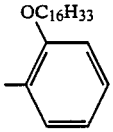 | $-CH_3$ | 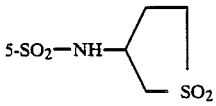 | H | $-C_6H_{13}$ |
| 14 | 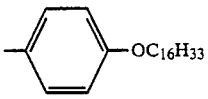 | $-CH_3$ | 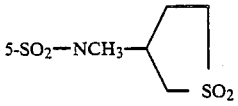 | H | $-C_6H_{13}$ |

-continued

| DIR-coupler (DIR-) | $R^1$ | $R^2$ | $R^3$ | $R^4$ | $R^5$ |
|---|---|---|---|---|---|
| 15 | 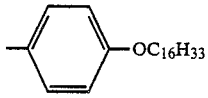 | $-CH_3$ | $4\text{-}SO_2N(CH_3)_2$ | H | $-C_6H_{13}$ |
| 16 | 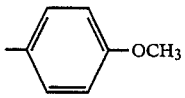 | $-C_{16}H_{33}$ | 5-Cl | H | $-CH_2-C\equiv CH$ |
| 17 | $-CH_3$ | $-C_{16}H_{33}$ | 5-Cl | H | $-CH_2-C\equiv CH$ |
| 18 | 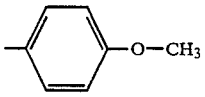 | $-C_{16}H_{33}$ | $5\text{-}SO_2-NH-CO-C_2H_5$ | $-C_3H_7$ | $-CH_2-C\equiv CH$ |
| 19 | 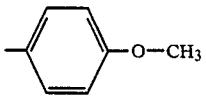 | $-C_{16}H_{33}$ | $5\text{-}SO_2-NH-CO-C_2H_5$ | $-C_3H_7$ | $-CH_2-C\equiv CH$ |
| 20 | 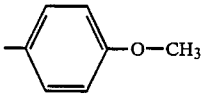 | $-C_{16}H_{33}$ | 5-Cl | $-C_3H_7$ | $-CH_2-C\equiv CH$ |
| 21 | 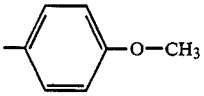 | $-C_{16}H_{33}$ | $5\text{-}SO_2-NH-CO-C_2H_5$ | 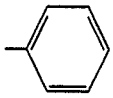 | $-CH_2-C\equiv CH$ |
| 22 | $-C_4H_9-t$ | $-C_{16}H_{33}$ | $5\text{-}SO_2-NH-CO-C_2H_5$ | H | 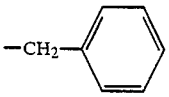 |
| 23 | 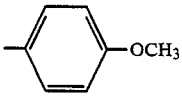 | $-C_{16}H_{33}$ | $5\text{-}SO_2-NH-CO-C_2H_5$ | H | 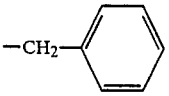 |
| 24 | 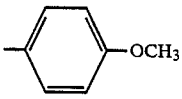 | $-C_{16}H_{33}$ | $5\text{-}SO_2-NCH_3-C_4H_9$ | H | 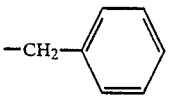 |
| 25 | 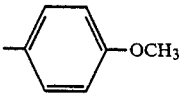 | $-C_{16}H_{33}$ | 5-Cl | H | 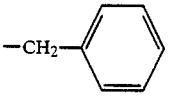 |
| 26 | 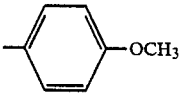 | $-CH_3$ | 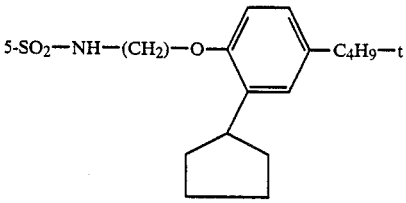 | H | 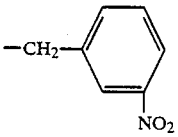 |
| 27 | 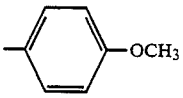 | $-C_{16}H_{33}$ | 5-Cl | H | 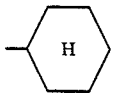 |

-continued

| DIR-coupler (DIR-) | $R^1$ | $R^2$ | $R^3$ | $R^4$ | $R^5$ |
|---|---|---|---|---|---|
| 28 | $-CH_3$ | $-C_{16}H_{33}$ | 5-$SO_2-NCH_3-C_4H_9$ | H | 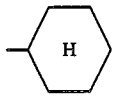 |
| 29 | 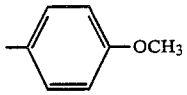 | $-C_{16}H_{33}$ | 5-$SO_2-NCH_3-C_4H_9$ | H | 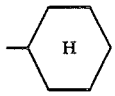 |

The DIR couplers according to the invention corresponding to formula I may readily be obtained by condensation of the known α-halogen-benzoyl acetanilide corresponding to forumla II

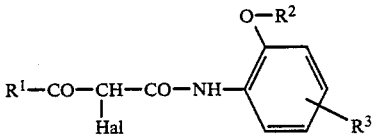

II wherein $R^1$ to $R^3$ have the meanings already indicated and

Hal denotes a halogen atom, in particular chlorine or bromine, with triazoles corresponding to the formula III

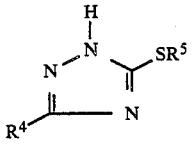

III wherein $R^4$ and $R^5$ have the meanings already indicated.

The reaction is advantageously carried out in an organic solvent such as dimethylformamide, acetonitrile or acetone in the presence of a base such as triethylamine or a caustic alkali.

The triazoles of formula III may in turn be obtained, for example, by reaction of the corresponding 3-mercapto1,2,4-triazoles with suitable alkyl halides.

Since the triazoles of formula III may occur in various tautomeric forms and various resonating structures may therefore be assigned to the corresponding aceniate ion, condensation could conceivably involve the linkage of any of the ring nitrogen atoms to the carbon atom in the coupling position. This would explain the occurrence of isomers. This isomerism, however, does not affect the use properties of the DIR couplers according to the invention and a detailed discussion of the structure of the possible isomers is therefore not necessary.

The preparation of DIR couplers according to the invention is explained below with reference to the DIR couplers 1 and 3 as examples.

DIR coupler 1

A solution of 62.9 g (0.1 mol) of α-chloro-α-pivaloyl-2-cetyloxy-5-(N-propionyl-sulphamoyl)-acetanilide in 250 ml of acetonitrile is added dropwise with stirring to a solution of 20.4 g (0.11 mol) of 3-hexylthio-(1,2,4-triazole) and 25.6 ml (0.205 mol) of tetramethylguanidine in 80 ml of acetonitrile at temperatures of 65° to 70° C. Stirring is then continued for one hour at 65° to 75° C. and the reaction mixture is stirred out on ice and adjusted acid to Congo red with HCl. The oily crude product is extracted with ethyl acetate. The ethyl acetate phase is extracted twice with water, dehydrated over sodium sulphate and concentrated by evaporation under vacuum. The oily residue is dissolved hot in 150 ml of ethanol and clarified with active charcoal.

25.4 g of colourless crystals with a melting point of 66° to 67° C. are obtained on cooling to room temperature.

DIR coupler 3

A solution of 48.6 g (0.1 mol) of α,5-dichloro-α-acetyl-2-cetyloxy-acetanilide in 150 ml of acetonitrile and 50 ml of dimethylacetamide is added dropwise with stirring to a solution of 20.4 g (0.11 mol) of 3-hexylthio-(1,2,4-triazole) and 28.1 ml (0.22 mol) of tetramethylguanidine in 50 ml of acetonitrile at temperatures of 60° to 65° C. The reaction mixture is heated to 75° C. for 30 minutes and then stirred out in ice water and acidified with dilute HCl until acid to Congo red indicator. The crude product crystallines completely within one hour. The produce is suction filtered, washed with water until neutral and then washed with alcohol. 36 g of almost colourless crystals with a melting point of 76° to 77° C. are obtained after recrystallisation from 220 ml of ethanol.

The compounds according to the present invention are suitable for use as yellow DIR couplers in colour photographic recording materials, in particular in multilayered materials. As they are yellow couplers, they are preferably used in or associated with a light-sensitive silver halide emulsion layer which is predominantly sensitive to the blue region of the visible spectrum. The special advantage of the yellow DIR couplers according to the invention, namely the comparatively slight extent to which they inhibit development in the layer with which they are associated combined with the comparatively powerful inhibition of devlopment in adjacent layers with which they are not associated is, of course, particularly important in a multilayered colour photographic material which in addition to the silver halide emulsion layer which is predominantly sensitive to the blue region of the spectrum also contains light-sensitive silver halide emulsion layers which are predominantly sensitive to the green or red region of the spectrum of visible light.

Since the DIR couplers according to the invention are exceptionally powerful, they may be used in comparatively small quantities to produce the desired effects, in particular the interimage effects. The DIR couplers according to the invention may therefore be used not only in the blue-sensitive layers which produce yellow dye but also in other layers without giving rise to excessive side densities. The DIR couplers according to the invention may therefore be advantageously used in magenta layers and cyan layers.

For the preparation of the light-sensitive colour photographic recording materials, the diffusion resistant DIR couplers of the present invention may be incorporated in a known manner in the casting solution for the silver halide emulsion layers or other colloid layers, optionally together with other couplers. Oil-soluble or hydrophobic couplers, for example, may advantageously be added to a hydrophilic colloid solution from a solution in a suitable coupler solvent (oil former), optionally in the presence of a wetting or a dispersing agent. The hydrophilic casting solution may, of course, contain the usual additives in addition to the binder. The coupler solution need not be directly dispersed in the casting solution for the silver halide emulsion layer or other water-permeable layer but may advantageously first be dispersed in an aqueous, light-insensitive solution of a hydrophilic colloid and the resulting mixture may then be added, either directly or optionally after removal of the low boiling organic solvent used, to the casting solution for the light-sensitive silver halide emulsion layer or other water-permeable layer before the solution is cast.

The light-sensitive silver halide emulsions may be emulsions of silver chloride, silver bromide or mixtures thereof, optionally with a silver iodide content of up to 10 mol-%, in one of the commonly used hydrophilic binders. The binder for photographic layers is preferably gelatine although this may be partly or completely replaced by other natural or synthetic binders.

The emulsions may be chemically and spectrally sensitized in the usual manner and the emulsion layers as well as other, light-insensitive layers may be hardened with known hardeners in the usual manner.

Colour photographic recording materials normally contain at least one silver halide emulsions layer for the recording of light from each of the three spectral regions red, green and blue. For this purpose, the light-sensitive layers are spectrally sensitized in a known manner with suitable sensitizing dyes. Blue-sensitive silver halide emulsion layers need not necessarily contain a spectral sensitizer since the intrinsic sensitivity of the silver halide is in many cases sufficient for recording blue light.

Each of the above-mentioned light-sensitive layers may consist of a single layer or they may be combined in a known manner in two or more silver halide emulsion partial layers, e.g. as in the so-called double layer arrangement (DE-C-1 121 470). Red-sensitive silver halide emulsion layers are normally arranged closer to the layer support than green-sensitive silver halide emulsion layers which in turn are arranged closer to the support than the blue-sensitive layers, and a light-insensitive yellow filter layer is generally interposed between the green-sensitive layers and the blue-sensitive layers, although other arrangements could conceivably be used. A light-insensitive interlayer which may contain substances to prevent accidental diffusion of developer oxidation products is generally arranged between layers differing in their spectral sensitivity. If a material contains several silver halide emulsion layers of the same spectral sensitivity, these layers may be directly adjacent to one another or they may be separated by a light-sensitive layer having a different spectral sensitivity (DE-A-1 958 709, DE-A-2 530 645, DE-A-2 622 922).

Colour photographic recording materials for the production of multicolour images normally contain colour producing compounds, in this case in particular colour couplers, in spatial and spectral association with the silver halide emulsion layers of the various spectral sensitivities for the production of partial images in the different colours, cyan, magenta and yellow.

By "spatial association" is meant that the colour coupler is situated in such a spatial relationship to the silver halide emulsion layer that the coupler and the layer can interact so that an imagewise correspondence between the silver image produced on development and the colour image produced from the colour coupler can be obtained. This is generally achieved by introducing the colour coupler into the silver halide emulsion layer itself or arranging it in an adjacent layer of binder which may be insensitive to light.

By "spectral association" is meant that the spectral sensitivity of each of the light-sensitive silver halide emulsion layers and the colour of the partial colour image produced from the spatially associated colour coupler have a particular relationship to one another, each of the spectral sensitivities (red, green, blue) being associated with a different colour of the partial colour image (e.g. cyan, magenta, yellow).

Each of the silver halide emulsion layers sensitized to different regions of the spectrum may have one or more than one colour coupler associated with it. When a photographic material contains several silver halide emulsion layers having the same spectral sensitivity, then each of these layers may contain a colour coupler and the various colour couplers need not necessarily be identical, provided only that on colour development they give rise to approximately the same colour, normally a colour which is complementary to the colour of the light to which the particular silver halide emulsion layers are predominantly sensitive.

In a preferred embodiment, therefore, red-sensitive silver halide emulsion layers have at least one non-diffusible colour coupler associated with them for producing the cyan partial colour image, generally a coupler of the phenol or $\alpha$-naphthol series. Suitable cyan couplers have been described, for example, in EP-A-0 028 099, EP-A-0 067 689, EP-A-0 175 573 and EP-A-0 184 057; green-sensitive silver halide emulsion layers have at least one non-diffusible colour coupler associated with them for producing the magenta partial colour image, normally a coupler of the 5-pyrazolone, indazolone or pyrazoloazole series; and blue-sensitive silver halide emulsion layers have at least one non-diffusible colour coupler associated with them for producing the yellow partial colour image, generally a colour coupler containing an open chain keto methylene group. Many colour couplers of this kind are known and have been described in numerous Patent Specifications; see also, for example, the publication "Farbkuppler" by W.PELZ in "Mitteilungen aus den Forschungslaboratorien der Agfa, Leverkusen/Munchen", Volume III, page 111 (1961) and the publication by K.VENKATARAMAN in "The Chemistry of Synthetic Dyes", Vol. 4, 341 to 387, Academic Press (1971).

The colour couplers may be either conventional 5-equivalent couplers or 2-equivalent couplers which require a smaller quantity of silver halide for producing the colour. 2-Equivalent coupelrs are derived, as is known, from 4-equivalent couplers in that they carry in their coupling position a subtituent which is split off in the coupling reaction. The 2-equivalent couplers include those which are virtually colourless and those which have an intense colour of their own which diappears in the colour coupling reaction to be replaced by the colour of the resulting image dye. The latter couplers may also be present in light-sensitive silver halide emulsion layers to serve as masking couplers to compensate for unwanted side densities of the image dyes. 2-Equivalent couplers also include the known white couplers which do not give rise to a dye in their reaction with colour developer oxidation products, and the known DIR couplers which carry in their coupling position a releasable group which is released as a diffusible development inhibitor in the reaction with colour developer oxidation products. Such couplers may also release other, photographically active compounds such as development accelerators or fogging agents during the development process.

According to this invention, the colour photographic recording material contains in addition at least one 2-equivalent yellow coupler corresponding to the formula I, which coupler may be present not only in the yellow layer but also in the magenta layer and/or in the cyan layer. or in a light-insensitive layer adjacent to one of the aforesaid layers.

In addition to the components already mentioned, the colour photographic material according to the present invention may contain other substances as additives, e.g. antioxidants, dye stabilizers and agents for influencing the mechanical and electrostatic properties. It is also advantageous to use UV absorbent compounds in one or more of the layers of the recording material, preferably in one of the upper layers, for the purpose of preventing or reducing the deleterious effect of UV light on the colour images produced with the colour photographic recording material of this invention. Suitable UV absorbents have been described, for example, in U.S. Pat. No. 3,253,921, DE-C-2 036 719 and EP-A-0 057 160.

The usual layer supports may be used for the materials according to the invention; see Research Disclosure No. 17 643, Section XVII.

The usual hydrophilic film formers may be used as protective colloids or bingers for the layers of the recording material, e.g. proteins, in particular gelatine. Casting auxiliaries and softeners may also be used; see the compounds mentioned in Research Disclosure No. 17 643, Sections IX, XI and XII.

The layers of the photographic material may be hardened in the usual manner, for example with hardeners of the epoxide series, the heterocyclic ethyleneimine series and acryloyl series. Hardening of the layers may also be carried out by the process according to DE-A-2 218 009 to produce colour photographic materials which are suitable for high temperature processing. The photographic layers may also be hardened with hardeners of the diazine, triazine or 1,2-dihydroquinoline series or with vinyl sulphone type hardeners. Other suitable hardeners have been disclosed in DE-A-2 439 551, DE-A-2 225 230, DE-A-2 317 672 and the above-mentioned Research Disclosure No. 17 643, Section XI.

Other suitable additives are mentioned in Research Disclosure No. 17 643 and in "Product Licensing Index", of December 1971, pages 107 to 110.

The colour photographic images are produced by developing the colour photographic material according to the invention with a colour developer compound. Any developer compounds which in the form of their oxidation products are capable of reacting with colour couplers to form azomethine dyes may be used as colour developers. Suitable colour developer compounds include aromatic compounds of the p-phenylene diamine series containing at least one primary amino group, for example, N,N-dialkyl-p-phenylenediamines such as N,N-diethyl-p-phenylenediamine, 1-(N-ethyl-N-methyl-sulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

Other suitable colour developers have been described, for example, in J.Amer.Chem.Soc. 73, 3100 (1951) and in G.Haist, Modern Photographic Processing, 1979, John Wiley and Sons, New York, pages 545 et seq.

The material is normally bleached and fixed after colour development. Bleaching and fixing may be carried out separately or together. The usual bleaching compounds may be used, e.g. $Fe^{3+}$ salts and $Fe^{3+}$ complex salts such as ferricyanides, dichromates, water-soluble cobalt complexes, etc. Iron-III complexes of aminopolycarboxylic acids are particularly preferred, e.g. the complexes of ethylenediaminotetracetic acid, of N-hydroxyethylethylenediaminotriacetic acid and of alkyliminodicarboxylic acids as well as of the corresponding phosphonic acids. Persulphates are also suitable bleaching agents.

Example 1

Various colour photographic materials were prepared, each containing a silver halide emulsion layer containing a DIR coupler (donor layer), an interlayer and a silver halide emulsion layer free from DIR coupler (acceptor layer).

The quantities given are based on 1 $m^2$. The quantities of silver halide applied are given in terms of the corresponding quantities of $AgNO_3$. The silver halide emulsions were stabilized with 0.5 g of 4-hydroxy-6-methyl-1,3,3a,7-tetraazaindene per 100 g of $AgNO_3$.

The following layers were applied in the sequence given to a transparent layer support of cellulose triacetate.

Layer 1: Green sensitized silver iodobromide emulsion (7 mol-% iodide; average grain diameter 0.6 μm) obtained from 4.25 g of $AgNO_3$ with 0.7 g of coupler C-1 and 2.5 g of gelatine.

Layer 2: (interlayer): obtained from 2.06 g of gelatine and 0.31 g of white coupler W-1.

Layer 3: Red-sensitized silver iodobromide emulsion (7 mol-% iodide; average grain diameter 0.6 μm) obtained from 4.25 g of $AgNO_3$ with 1 g of coupler M-1, 0.43 mmol of DIR coupler (see Table 1) and 2.5 g of gelatine.

Layer 4: (protective layer): 0.46 g of gelatine and 0.47 g of carbamoylpyridinium salt (CAS Reg.No. 65411-60-1).

Compounds C-1, M-1 and the DIR couplers were introduced in the form of emulsions as described in Example 2.

Different materials 1 to 8 were obtained by this method, the materials differing only in the DIR coupler used in Layer 3. Development was carried out after exposure to reflected light through a grey wedge as described in "The Journal of Photography", 1974, pages 597 and 598.

The results are shown in Table 1. Inhibition is calculated according to the following equation:

$$I = 1 - \gamma\text{with DIR coupler}/\gamma\text{without DIR coupler}$$

as described in EP-A-O 145 460.

KE is the difference between the microdensity and macrodensity at macrodensity = 1 as described by James, in The Theory of the Photographic Process, 5th Edition, Macmillan Publishing Co. Inc. 1977, page 611.

TABLE 1

| Material | DIR coupler | Inhibition Layer 1 | Inhibition Layer 3 | KE |
|---|---|---|---|---|
| 1 | A | 46 | 50 | 0.35 |
| 2 | B | 60 | 66 | 0.46 |
| 3 | 15 | 57 | 62 | 0.58 |
| 4 | 12 | 63 | 64 | 0.51 |
| 5 | 22 | 23 | 52 | 0.51 |
| 6 | 7 | 56 | 67 | 0.67 |
| 7 | 3 | 59 | 67 | 0.54 |
| 8 | 9 | 58 | 72 | 0.63 |

The following DIR couplers were used for comparison in materials 1 and 2: DIR coupler A (Compound 4 of DE-A-3 427 235)

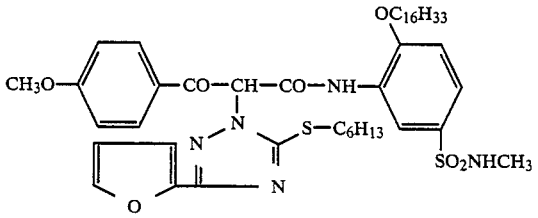

DIR coupler B (Compound 202 of DE-A-2 842 063)

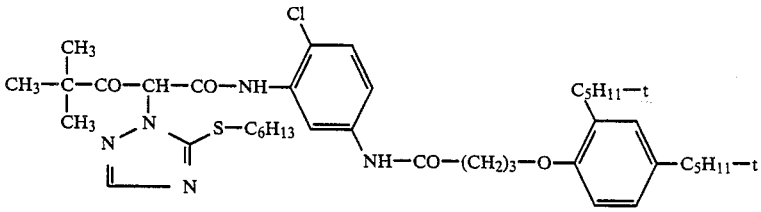

Example 2

A color photographic recording material for colour negative development was prepared by applying the following layers in the given sequence to a transparent layer support of cellulose triacetate. The quantities are based on 1 $m^2$. The quantities of silver halide applied are given in terms of the corresponding quantities of $AgNO_3$. All silver halide emulsions were stabilized with 0.5 g of 4-hydroxy-6-methyl-1,3,3a,7-tetraazaindene per 100 g of $AgNO_3$.

Layer 1 (Antihalation layer): Black colloidal silver sol containing 0.4 g of Ag and 3 g of gelatine.

Layer 2 (1st red-sensitized layer): red-sensitized silver iodobromide emulsion (7 mol-% iodide; average grain diameter 0.6 μm) of 2.7 g of $AgNO_3$ with 0.51 g of coupler C-1. 0.078 g of masking coupler MC-1 DIR coupler (see Table 2) and 1.5 g of gelatine.

Layer 3 (2nd red-sensitized layer): red-sensitized silver iodobromide emulsion (10 mol-% iodide; average grain diameter 1.5 μm) of 3.8 g of $AgNO_3$ with 0.137 g of Coupler C-1 and 2.7 g of gelatine.

Layer 4 (interlayer) 0.15 of white coupler W-1 and 0.8 g of gelatine.

Layer 5 (1st green-sensitized layer) green-sensitized silver iodobromide emulsion (7 mol-% iodide; average grain diameter 0.6 μm) of 2.0 g of $AgNO_3$ with 0.403 g of coupler M-1, 0.175 g of masking coupler MC-2, DIR coupler (see Table 2) and 1.4 g of gelatine.

Layer 6 (2nd green-sensitized layer) green-sensitized silver iodobromide emulsion (4 mol-% iodide; average grain diameter 1.4 μm) of 2.5 g of $AgNO_3$ with 0.2 g of coupler M-1 and 1.6 g of gelatine.

Layer 7 (interlayer): 0.1 g of white coupler W-1 and 0.34 g of gelatine.

Layer 8 (yellow filter layer): yellow colloidal silver sol containing 71 mg of Ag, 0.1 g of white coupler W-1 and 0.5 g of gelatine.

Layer 9 (1st blue-sensitive layer): silver iodobromide emulsion (4.5 mol-% iodide; average grain diameter 0.5 μm) of 0.5 g of $AgNO_3$ with 0.8 g of coupler Y-1, DIR coupler (see Table 2) and 1.4 g of gelatine.

Layer 10 (2nd blue-sensitive layer) silver iodobromide emulsion (10 mol-% iodide; average grain diameter 1.5 μm) of 0.8 g of $AgNO_3$ with 2.81 g of coupler Y-1 and 1.4 g of gelatine.

Layer 11 (protective layer) 0.7 g of gelatine.

Layer 12 (hardening layer) 0.24 g of gelatine and 0.7 g of carbamoylpyridinium salt (CAS Reg. No 65411-60-1).

Compounds C-1, M-1, MC-2, Y-1 and the DIR couplers were used in the form of emulsions containing 1 part of gelatine, 2 parts of tricresylphosphate in the case of Compounds M-1 and MC-2 and of di-n-butylphthalate in all the other cases, and 0.1 part of the sodium salt of triisopropylnaphthalene sulphonic acid as wetting agent, based on 1 part of the compound used.

Various versions (materials 8–13) of the recording material composed of the layers described above were prepared. These versions differed from one another only in the DIR couplers used in layers 2, 5 and 9.

The results obtained after processing as described in Example 1 are shown in Table 2. The interimage effects IIE are calculated as follows:

$$IIE_{cyan} = \frac{\gamma_{red} - \gamma_w}{\gamma_w}\ ;\ IIE_{magenta} = \frac{\gamma_{green} - \gamma_w}{\gamma_w}\ .$$

In these equations, $\gamma_{red}$ denotes gradation on selective exposure to red light $\gamma_{green}$ denotes gradation on selective exposure to green light $\gamma_w$ denotes gradation on exposure to white light $KE_{cyan}$ denotes KE in the red-sensitized layer $KE_{magenta}$ denotes KE in the green-sensditized layer

TABLE 2

| Material | DIR coupler | $\times 10^{-5}$ mol in layer 2 | 5 | 9 | $IIE_{cyan}$ | $IIE_{magenta}$ | $KE_{cyan}$ | $KE_{magenta}$ |
|---|---|---|---|---|---|---|---|---|
| 9 | B | 4.95 | 2.73 | 4.8 | 12 | 29 | 0.19 | 0.20 |
| 10 | 15 | 6.33 | 4.62 | 7.4 | 25 | 36 | 0.25 | 0.26 |
| 11 | 7 | 5.78 | 2.73 | 4.8 | 27 | 28 | 0.29 | 0.26 |
| 12 | 4 | 4.95 | 2.73 | 4.8 | 13 | 30 | 0.22 | 0.22 |
| 13 | 9 | 5.50 | 2.73 | 4.8 | 22 | 39 | 0.30 | 0.27 |

The quantities of DIR coupler in layers 2, 5, 9 were varied so that comparable gradations could be obtained with materials 9 to 13.

The following compounds were used in Examples 1 and 2:

Coupler C-1

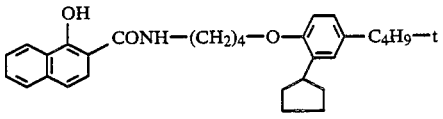

White coupler W-1

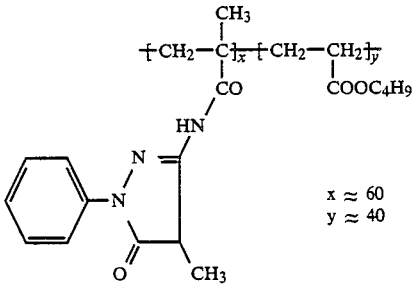

Coupler M-1

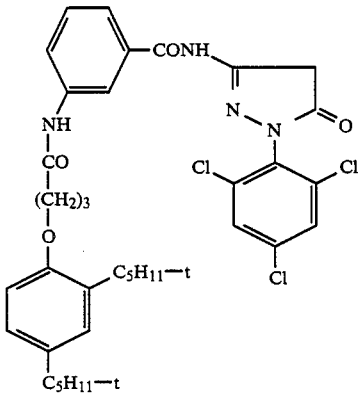

Masking coupler MC-1

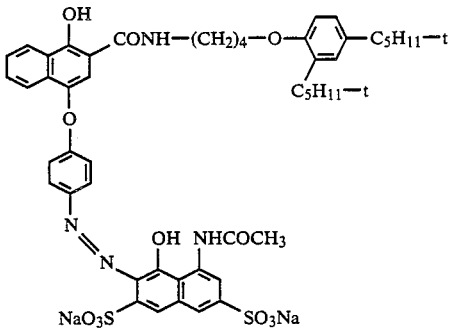

Masking coupler MC-2

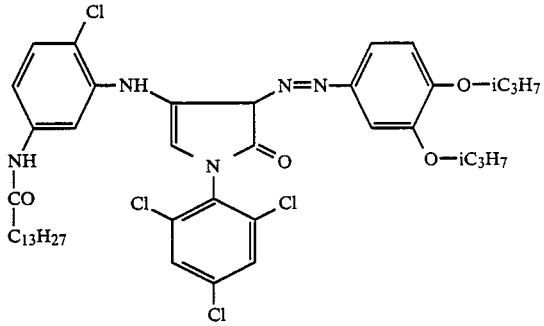

Coupler Y-1

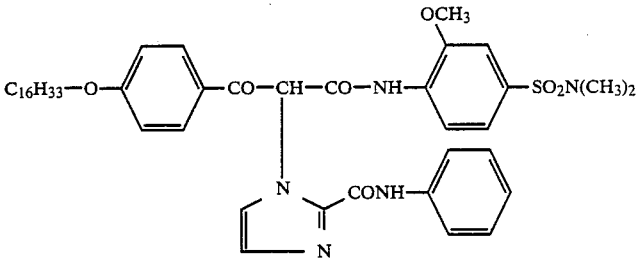

We claim:

1. Colour photographic recording material containing at least one light-sensitive silver halide emulsion layer and having associated with this layer a DIR coupler carrying a releasable 1,2,4-triazolyl group attached to the coupling position of a yellow coupler, characterised in that the DIR coupler corresponds to the following formula:

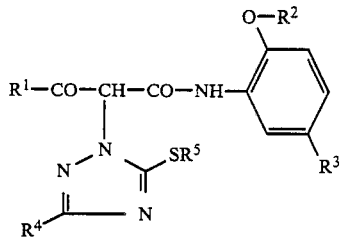

wherein $R^1$ denotes alkyl or aryl, $R^2$ denotes alkyl with up to 18 carbon atoms, $R^3$ denotes halogen $SO_2—R^6$, $SO_2—NR^7—R^8$ or $NH—SO_2—R^6$, $R^4$ denotes H, alkyl or aryl, $R^5$ denotes alkyl, cycloalkyl, alkinyl, aralkyl or aryl, $R^6$ denotes alkyl or aryl, $R^7$ denotes H or alkyl and $R^8$ denotes H, alkyl, aryl, $CO—R^6$ or

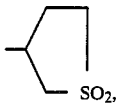

and the total number of carbon atoms in $R^4$ and $R^5$ is not greater than 11.

2. Recording material according to claim 1 charcterised in that the DIR coupler is contained in a silver halide emulsion layer which is predominantly blue-sensitive and in that the recording material contains at least one other, predominantly green-sensitive or predominantly red-sensitive silver halide emulsion layer.

3. Colour photographic recording material according to claims 1 or 2, characterised in that the DIR coupler is contained in a predominantly red-sensitive silver halide emulsion layer.

4. Colour photographic recording material containing at least one predominantly blue-sensitive silver halide emulsion layer unit with which at least one yellow coupler is associated, a predominantly green-sensitive silver halide emulsion layer unit with which at least one magenta coupler is associated and a predominantly red-sensitive silver halide emulsion layer unit with which at least one cyan coupler is associated, characterised in that at least one partial layer of the predominantly greensensitive silver halide emulsion layer unit or of the predominantly red-sensitive corresponding to the following formula:

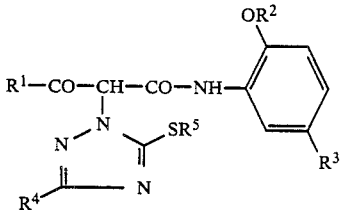

wherein $R^1$ denotes alkyl or aryl, $R^2$ denotes alkyl with up to 18 carbon atoms, $R^3$ denotes halogen, $SO—_2—R^6$, $SO_2—NR^7—R^8$ or $NH—SO_2—R^6$, $R^4$ denotes H, alkyl or aryl, $R^5$ denotes alkyl, cycloalkyl, alkinyl, aralkyl or aryl, $R^6$ denotes alkyl or aryl, $R^7$ denotes H or alkyl and $R^8$ denotes H, alkyl, aryl, $CO—R^6$ or

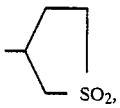

and the total number of carbon atoms in $R^4$ and $R^5$ is not greater than 11.

* * * * *